US011441770B2

(12) United States Patent
Polanowski et al.

(10) Patent No.: US 11,441,770 B2
(45) Date of Patent: Sep. 13, 2022

(54) METHOD FOR MANUFACTURING ILLUMINATED ATHLETIC WEAR

(71) Applicant: Timothy Polanowski, Towson, MD (US)

(72) Inventors: Timothy Polanowski, Towson, MD (US); Douglas Pemberton, Baltimore, MD (US); Shannon Wheeler, Baltimore, MD (US); Kelsey Schroeder, Baltimore, MD (US); Brett Potter, Baltimore, MD (US); Matthew Jennings, Towson, MD (US)

(73) Assignee: Timothy Polanowski, St. Pete Beach, FL (US)

( * ) Notice: Subject to any disclaimer, the term of this patent is extended or adjusted under 35 U.S.C. 154(b) by 0 days.

(21) Appl. No.: 17/058,315

(22) PCT Filed: May 24, 2019

(86) PCT No.: PCT/US2019/033898
§ 371 (c)(1),
(2) Date: Nov. 24, 2020

(87) PCT Pub. No.: WO2019/226979
PCT Pub. Date: Nov. 28, 2019

(65) Prior Publication Data

US 2021/0207794 A1 Jul. 8, 2021

Related U.S. Application Data

(60) Provisional application No. 62/676,450, filed on May 25, 2018.

(51) Int. Cl.
*F21V 33/00* (2006.01)
*A41D 27/08* (2006.01)
(Continued)

(52) U.S. Cl.
CPC ..... *F21V 33/0008* (2013.01); *A41D 1/06* (2013.01); *A41D 27/085* (2013.01);
(Continued)

(58) Field of Classification Search
CPC .. F21V 33/0008; F21V 23/002; F21V 23/003; A41D 1/06; A41D 27/085; A41D 13/01; A41D 27/08; F21Y 2115/10
See application file for complete search history.

(56) References Cited

U.S. PATENT DOCUMENTS 6,729,025 B2 5/2004 Farrell et al.
9,470,411 B1 * 10/2016 Ramsey ..... A41B 9/00
(Continued)

FOREIGN PATENT DOCUMENTS

CN 102727182 A 10/2012
CN 106969279 A * 7/2017
(Continued)

OTHER PUBLICATIONS

PCT International Search Report (Form PCT/ISA/210) for corresponding/related International Application No. PCT/US2019/033898 dated Aug. 9, 2019.
(Continued)

*Primary Examiner* — Tracie Y Green
(74) *Attorney, Agent, or Firm* — Patent Portfolio Builders PLLC

(57) ABSTRACT

A method of manufacturing an illuminated athletic wear garment and an improved illuminated athletic wear garment. The method may include applying a first conductive trace to a surface of a first piece of fabric of the illuminated athletic wear garment and applying a second conductive trace to the surface of the first piece of fabric of the illuminated athletic wear garment. The method may further include affixing a plurality of lights to the illuminated athletic wear garment.
(Continued)

The lights may each be connected to the first conductive trace and the second conductive trace. The first conductive trace and the second conductive trace may each be at least ¼ inch wide.

19 Claims, 7 Drawing Sheets

(51) Int. Cl.

| | |
|---|---|
| ***A41D 1/06*** | (2006.01) |
| ***F21V 23/00*** | (2015.01) |
| *F21Y 115/10* | (2016.01) |
| *A41D 13/01* | (2006.01) |

(52) U.S. Cl.
CPC ..... *F21V 23/002* (2013.01); *F21V 23/003* (2013.01); *A41D 13/01* (2013.01); *F21Y 2115/10* (2016.08)

(56) References Cited

U.S. PATENT DOCUMENTS

| | | | | |
|---|---|---|---|---|
| 10,312,415 | B2 * | 6/2019 | Holbery | H01L 33/62 |
| 10,499,502 | B2 * | 12/2019 | de Kok | H05K 1/038 |
| 2007/0056075 | A1 | 3/2007 | Golle et al. | |
| 2011/0119812 | A1 | 5/2011 | Genz et al. | |
| 2013/0027963 | A1 * | 1/2013 | Van Herpen | H05K 1/189 362/551 |
| 2014/0070957 | A1 | 3/2014 | Longinotti-Buitoni et al. | |
| 2016/0320037 | A1 | 11/2016 | Wong et al. | |
| 2016/0348889 | A1 * | 12/2016 | Polanowski | A41D 13/01 |
| 2016/0348890 | A1 * | 12/2016 | Polanowski | H04R 1/028 |
| 2017/0086513 | A1 | 3/2017 | Maxey et al. | |
| 2017/0105465 | A1 | 4/2017 | Kuddo | |
| 2018/0017248 | A1 | 1/2018 | Athauda et al. | |

FOREIGN PATENT DOCUMENTS

| | | | | |
|---|---|---|---|---|
| CN | 108345380 | A * | 7/2018 | A41D 1/005 |
| CN | 210582638 | U * | 5/2020 | |
| WO | WO-2005124015 | A1 * | 12/2005 | B44F 1/10 |
| WO | 2018005932 | A1 | 1/2018 | |

OTHER PUBLICATIONS

PCT Written Opinion of the International Searching Authority (Form PCT/ISA/237) for corresponding/related International Application No. PCT/US2019/033898 dated Aug. 9, 2019.
Examiner's Search and Report in related/corresponding GB Application No. 2018453.7 dated Mar. 10, 2022.
Office Action in related/corresponding Chinese Application No. 201980040488.1 dated Apr. 19, 2022.

* cited by examiner

METHOD FOR MANUFACTURING ILLUMINATED ATHLETIC WEAR

TECHNICAL FIELD

Embodiments of the present invention relate generally to the field of garments and particularly to illuminated athletic wear used by runners, bikers, and other non-contact sport athletes.

BACKGROUND

Many exercise enthusiasts do not have the ability to dictate the time of the day for which they workout. This may be due to multiple factors including work schedule requirements, commute times, and even environmental considerations. For example, many athletes work traditional work hours and have long commute times to and from work. Still others may live in a relatively hot environment where it is difficult to run during the heat of the day. In each of these situations, athletes may have no alternative other than to exercise at night. Also, there may be places and/or events where the lack of lighting is not optimal for the safety of the athlete.

Athletic wear is typically designed principally with comfort of the athlete in mind. For example, running pants may be designed to be lightweight and to pull moisture away from the skin. Accordingly, running pants are often tight fitting and made of a stretchable moisture wicking material. Many current offerings are black or a dark gray which may be difficult for others to see at night. Dark color offerings are certainly not the rule, and in fact there are many offerings that are designed with style in mind (e.g., having stylish patterns and bright colors). However, even these stylish and colorful running pants may be difficult for others to see at night. If others (e.g., such as those operating automobiles) are unable to clearly see an athlete running at night, then there is an increased safety risk for the athlete.

Limited means exist for increasing the visibility of an athlete at night, or otherwise in darkness. One solution is for an athlete to carry a flashlight. However, even a small flashlight requires holding by the athlete which can interfere with the athlete's workout. Further, a flashlight may be focused and thereby may not increase visibility of the athlete from multiple angles. Another proposed solution includes providing lights connected by wires on an item of athletic apparel. While this solution represents an improvement relative to simply carrying a flashlight, the wires connecting the lights and the mechanisms required to attach the lights to the athletic apparel may present challenges in terms of manufacturing, durability, and stretchability.

In light of the foregoing and other shortcomings in the art, it is desirable to provide an improved method of manufacturing athletic wear and improved athletic wear.

SUMMARY

It is an aspect of the present invention to provide a method of manufacturing an illuminated athletic wear garment.

It is a further aspect of the present invention to provide an improved illuminated athletic wear garment.

According to an embodiment a method of manufacturing an illuminated athletic wear garment is provided. The method may include applying a first conductive trace to a surface of a first piece of fabric of the illuminated athletic wear garment and applying a second conductive trace to the surface of the first piece of fabric of the illuminated athletic wear garment. The method may further include affixing a plurality of lights to the illuminated athletic wear garment. The lights may each be connected to the first conductive trace and the second conductive trace. The first conductive trace and the second conductive trace may each be at least ¼ inch wide.

According to another embodiment a method of manufacturing an illuminated athletic wear garment is provided. The method may include applying a first conductive trace to a surface of a first piece of fabric of the illuminated athletic wear garment. The method may further include applying a second conductive trace to the first piece of fabric of the illuminated athletic wear garment. The first conductive trace and the second conductive trace may each be at least ¼ inch wide.

According to another embodiment an illuminated athletic wear garment is provided. The illuminated athletic wear garment may include an outer surface and a first conductive trace affixed to the outer surface of the illuminated athletic wear garment. The illuminated athletic wear garment may further include a second conductive trace affixed to the outer surface of the illuminated athletic wear garment and a plurality of lights each connected to the first conductive trace and the second conductive trace. The first conductive trace and the second conductive trace may each be at least ¼ inch wide.

BRIEF DESCRIPTION OF THE DRAWINGS

The accompanying drawings, which are incorporated in and constitute a part of the specification, illustrate one or more embodiments and, together with the description, explain these embodiments. In the drawings.

DESCRIPTION OF THE EMBODIMENTS

Figure 1:
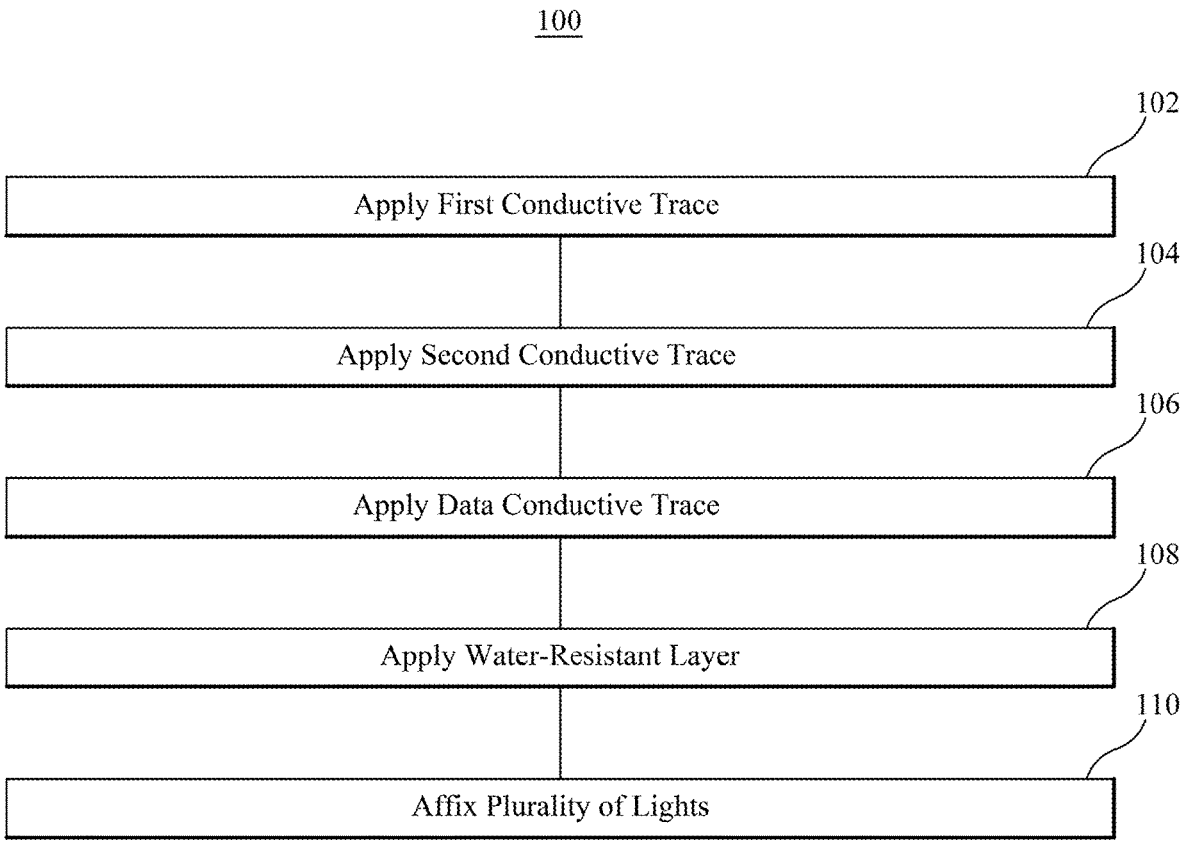
FIG. 1 is a schematic representation of an exemplary method of manufacturing an illuminated athletic wear garment according to an embodiment of the present invention.

The following description of the embodiments refers to the accompanying drawings. The same reference numbers in different drawings identify the same or similar elements. The following detailed description does not limit the invention. The embodiments to be discussed next are not limited to the configurations described below but may be extended to other arrangements as discussed later.

The terms "a", "an" and "the" may refer to one or more than one of an element (e.g., item, act, feature, or characteristic). Similarly, a particular quantity of an element may be described or shown while the actual quantity of the element may differ. The terms "and" and "or" may be used in the conjunctive or disjunctive sense and will generally be understood to be equivalent to "and/or". Reference to "one embodiment", "an embodiment", "some embodiments", or the like, means that a particular element described in connection with an embodiment is included in at least one embodiment of the subject matter disclosed. Thus, the appearance of the phrases "in one embodiment" or "in an embodiment" in various places throughout the specification is not necessarily referring to the same embodiment. Further, the particular elements may be combined in any suitable manner in one or more embodiments. Elements described as being separate may be combined into a single element. Similarly, elements described as being individual may be split into two or more elements. For example, although single first and second conductive traces are described, a conductive trace may be formed of a plurality of conductive trace segments. As another example, although operation 108 (described below) is depicted as a single operation in FIG. 1, multiple water-resistant layers may be applied at various stages. References to "alternative embodiments" or elements described "alternatively" are not necessarily meant to demarcate mutually exclusive alternatives and may be interpreted in some cases as "alternatively and/or additionally". The organization of certain elements may be for ease of comprehension. For example, an order of operations of a method may be varied. For example, operation 104 (described below) may occur before operation 102, or even at the same time. When an element is described as "affixed", "attached", "connected", "coupled", or otherwise linked to another element, it may be directly linked to the other element, or intervening elements may be present.

As mentioned above, the present inventor has recognized that limited means exist for increasing the visibility of an athlete at night, or otherwise in darkness. Flashlights and headlamps (worn on a user's head) may be cumbersome and may not provide visibility from multiple angles. Providing lights connected by wires on an item of athletic apparel may be less cumbersome and may increase visibility, however; the wires connecting the lights and the mechanisms required to attach the lights to the athletic apparel and wires may present challenges in terms of manufacturing, durability, and stretchability.

Before turning to the drawings, a non-limiting overview of some of the embodiments is provided. According to an embodiment, an inventive method of manufacturing an illuminated athletic wear garment may be provided. Stretchable conductive traces may be affixed to the illuminated athletic wear garment. One or more water-resistant layers may be applied to the conductive traces providing electrical insulation and protection. Lights may be affixed to the illuminated athletic wear garment wherein a first conductive trace and a second conductive trace may each be in communication with each of the lights. The conductive traces may be stretchable while still being suitably thick for purposes of illuminating the lights (e.g., at least ¼ inch wide).

According to another exemplary embodiment, an inventive illuminated athletic wear garment may be provided. A first conductive trace and a second conductive trace may each be affixed to the outer surface of the illuminated athletic wear garment. In an embodiment, the first conductive trace may be a power conductive trace and may be connected to a positive terminal of a power supply. The second conductive trace may be a return conductive trace and may be connected to a negative terminal of a power supply. In an embodiment, one or more water-resistant layers (e.g., one or more of an overlay and an underlay) may be applied to the first conductive trace and the second conductive trace. Multiple lights may each be connected to the first conductive trace and the second conductive trace. The conducive traces may be stretchable while still being suitably thick for purposes of illuminating the lights (e.g., at least ¼ inch wide). One of ordinary skill in the art will appreciate that while some embodiments are described with reference to lights, other suitable electronic input and/or output devices may be substituted, where appropriate, to function with the conductive traces.

In an embodiment, the lights may be multi-color light-emitting diode (LED) lights, each including an onboard control module. In addition to the first conductive trace and the second conductive trace, a data conductive trace may be affixed to the outer surface of the illuminated athletic wear garment and connected to each of the LED lights. An illumination (such as an on/off state, a color, and/or a power level) of the LED lights may be controllable.

Figures 2A, 2B, 2C:
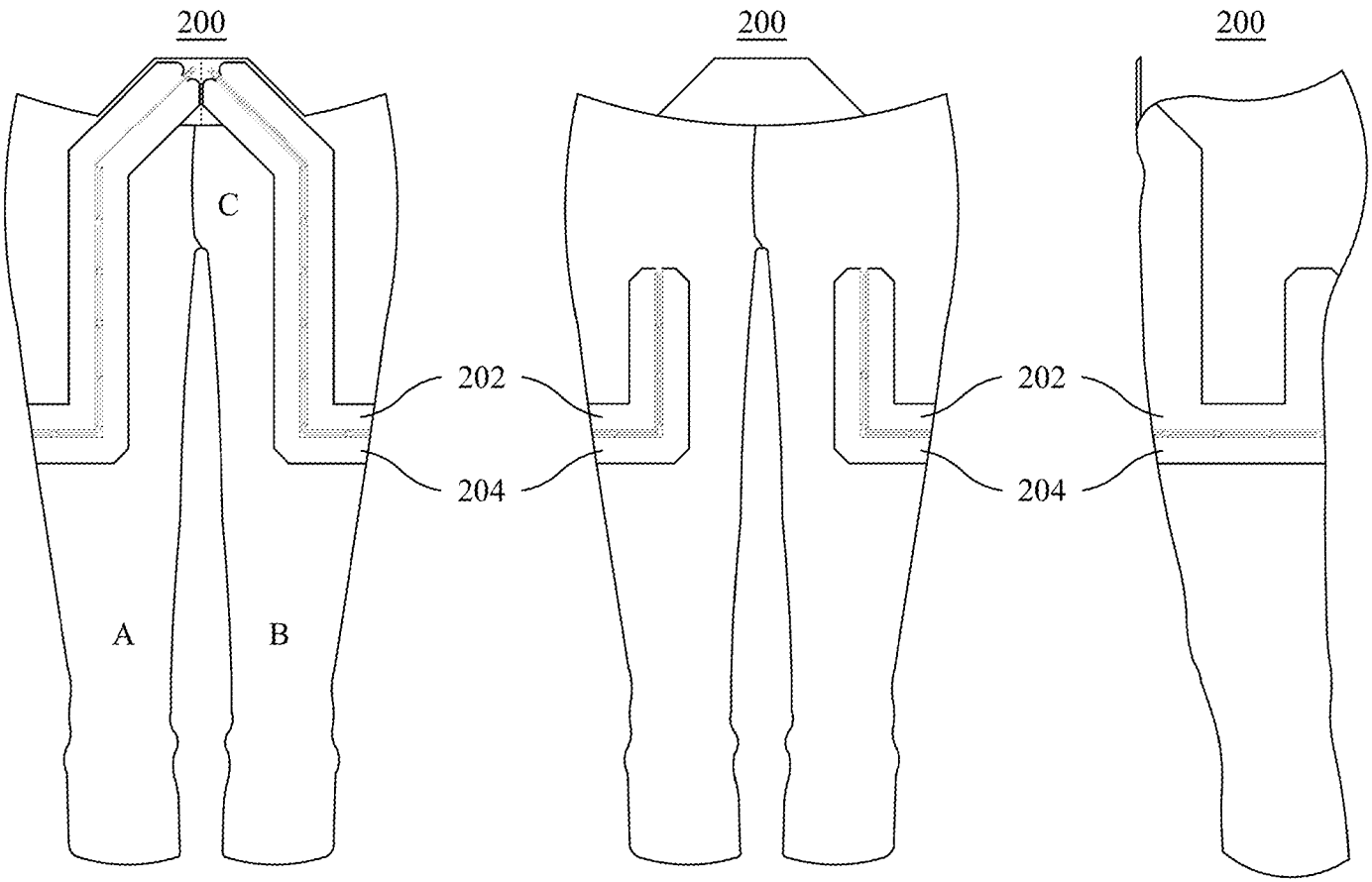
FIGS. 2A, 2B, and 2C are schematic representations of an exemplary illuminated athletic wear garment according to an embodiment of the present invention, such as may be produced by the method of FIG. 1.

Turning next to the drawings, FIG. 1 is a schematic representation of an exemplary method 100 of manufacturing an illuminated athletic wear garment according to an embodiment of the present invention. FIGS. 2A, 2B, and 2C are schematic representations of an illuminated athletic wear garment 200, such as may be produced by the method 100 of FIG. 1.

An illuminated athletic wear garment may take many different forms. That is, while the illuminated athletic wear garment 200 of FIGS. 2A, 2B, and 2C is shown as women's running pants, the principles and elements of the present invention may be embodied as men's or women's running pants, men's or women's shorts, skirts, dresses, swimsuits, shirts, and the like. Each of these alternatives is considered to be within the scope of the present application and the present claims. For clarity of disclosure, the women's running pants embodiment is discussed further herein.

In operation 102, a first conductive trace 202 may be applied to the illuminated athletic wear garment 200. In operation 104, a second conductive trace 204 may be applied to the illuminated athletic wear garment 200. For example, the first and second conductive traces 202, 204 may be applied to the illuminated athletic wear garment 200 by screen printing. The first conductive trace 202 may be a power conductive trace and may be connected to a positive terminal of a power supply. The second conductive trace 204 may be a return conductive trace and may be connected to a negative terminal of a power supply. One of ordinary skill in the art will appreciate that the polarity of the conductive traces may be reversed, that is, the first conductive trace 202 may be a return and may be connected to a negative terminal of the power supply, and the second conductive trace 204 may be power and may be connected to a positive terminal of the power supply. Although the first and second conductive traces 202 and 204 are shown herein as each being a single conductive trace, an alternative embodiment may include a plurality of first and second conductive trace segments that run from light to light, or that are otherwise segmented.

The first conductive trace 202 and second conductive trace 204 may be formed using ink including a conductive material. For example, the first conductive trace 202 and second conductive trace 204 may be formed using ink or paint including approximately sixty-six percent (66%) silver. Because one or more embodiments seek to provide a comfortable athletic wear garment, it may be desirable to reduce heat generation in providing illumination. At the same time and also for user comfort, it is desirable that the conductive traces are stretchable. Silver has been found to have both low resistance and a high degree of stretchability. Accordingly, conductive traces 202, 204 formed from conductive ink including silver may be provided on a substrate such as a polymer substrate. Alternatively, ink or paint may be infused with other conductive materials such as graphite.

As another alternative embodiment, solid copper may be provided, e.g., on a polymer substrate in a manner analogous to copper being used on a Printed Circuit Board (PCB). Copper traces may be desirable with respect to cost and also with respect to bondability. Accordingly, conductive traces 202, 204 formed from copper may be provided on a substrate.

In an embodiment, the first conductive trace 202 and the second conductive trace 204 may each be greater than one-quarter (¼) inch wide. Preferably, the first conductive trace 202 and the second conductive trace 204 may be from one-quarter (¼) inch to three (3) inches wide. More preferably, from one-half (½) inch to two-and-one-half (2½) inches wide, and most preferably, from three-quarters (¾) inch to two (2) inches wide. For example, the first conductive trace 202 and the second conductive trace 204 may each be approximately one (1) inch wide. It will be appreciated that the width may be consistent for most if not all of the length of the first and second conductive traces, but that in some embodiments, the width may vary over portions, such as where the first and second conductive traces start or end, and where curves or turns may be present in the design of the first and second conductive traces. In an embodiment, the height (i.e., thickness) of the first and second conductive traces may be, at least at portions, between 0.01 mills and 50 mills. Depending upon the number of lights to be powered by the first and second conductive traces, a current of approximately 300 to 400 milliamps of current may flow through each of the first and second conductive traces. One of ordinary skill in the art will appreciate that alternative sizes and dimensions may be possible with, e.g., alternative materials and designs, and that such alternatives fall within the scope of the present disclosure.

Figure 6:
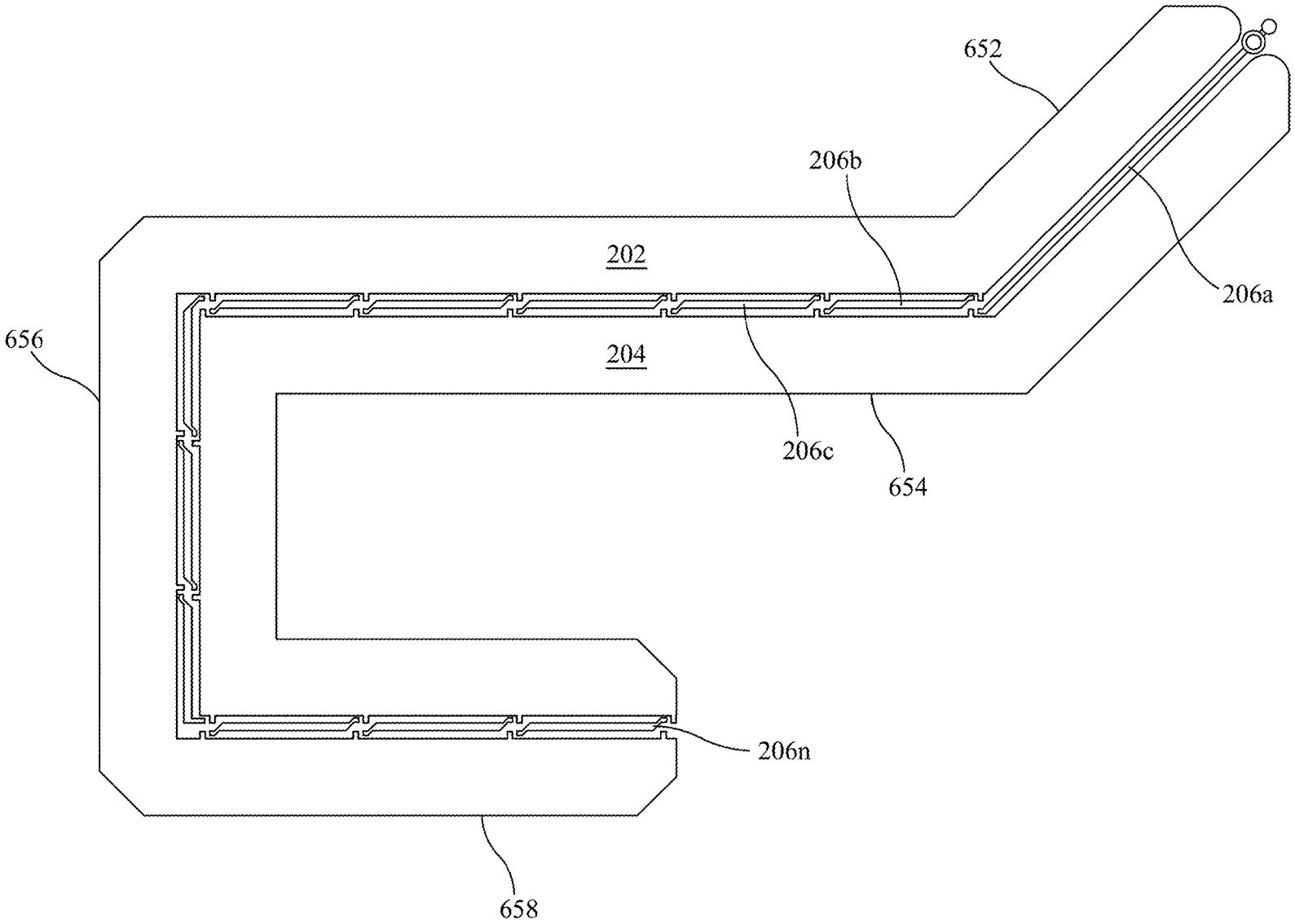
FIG. 6 is a schematic representation of an exemplary conductive trace sheet, such as the conductive ink sheet of FIG. 4.

In some embodiments, a data conductive trace 206 may be applied (operation 106) to the surface of the fabric, see, e.g., FIG. 6. In an embodiment, the data conductive trace may be formed of a plurality of data conductive trace segments 206*a*, 206*b*, . . . 206*n*. The plurality of data conductive trace segments 206*a*, 206*b*, . . . 206*n* may run between each of a plurality of lights (see, e.g., FIG. 7) and a power pack. Although the data conductive trace 206 is shown herein as a plurality of data conductive trace segments 206*a*, 206*b*, . . . 206*n*, an alternative embodiment may include a single data conductive ink trace.

The data conductive trace 206 may be formed from a conductive material such as ink or paint including silver, or alternatively, ink or paint including other conductive materials such as graphite. In an embodiment, the data conductive ink trace 206 may be, e.g., a sixteenth of an inch or less. Depending upon the number of lights to be controlled using the data conductive ink trace, a current of less than one milliamp may flow through the data conductive ink trace. Alternatively, the data conductive trace 206 may be formed from copper.

In an embodiment, one or more water-resistant layers (e.g., one or more of an overlay and an underlay) may be applied to the conductive traces in operation 108. More detail is provided below regarding application of water-resistant layers.

In operation 110, a plurality of lights may be affixed to the illuminated athletic wear garment.

In an embodiment having a data conductive trace 206, one or more of the lights (see, e.g., FIG. 8, 840) may include a control module (842). For example, each of the plurality of lights may include a control module. Each control module may include a connection to the first conductive trace, a connection to the second conductive trace, an input connection to one of the plurality of data conductive trace segments, and an output connection configured for connection to another of the plurality of data conductive trace segments. An illumination of each of the plurality of lights may be individually controllable.

A control module of a first of the plurality of lights may receive an input data signal through the input connection and may transmit an output signal through the output connection. In an embodiment, the input data signal may include first light data for controlling the first of the plurality of lights, second light data for controlling a second of the plurality of lights, and so on for however many lights are to be controlled. Finally, the input data signal may include last light data for controlling a last of the plurality of lights. A control module of the last of the plurality of lights may receive an input data signal through the input connection of the control module of the last of the plurality of lights.

For example, in an embodiment where ten lights are placed along the first, second, and data conductive traces 202, 204, 206, ten data packets may be transmitted along the data conductive trace 206 from, e.g., control circuitry of a power pack to the control module of the first of the ten lights. The ten packets may form a largest data transmission. The control module of the first of the ten lights may receive the data transmission through its input connection. The control module of the first of the ten lights may use the first of ten data packets to control its illumination. The control module of the first of the ten lights may output through its output connection the remaining nine data packets to the second of the ten lights. The control module of the second of the ten lights may receive the data transmission (which may, in an embodiment, be truncated relative to the original data transmission and may now be a next largest data transmission) through its input connection. The control module of the second of the ten lights may use the second of the ten data packets to control its illumination. The control module of the second of the ten lights may output through its output connection the remaining eight data packets to the third of the ten lights. This may continue, in like manner, until the control module of the last (or tenth in this example) light receives the data transmission (which may, in an embodiment, be truncated to all of the earlier transmissions and may now be the shortest data transmission of the data transmissions) through its input connection. The control module of the last light may use the last (or tenth) packet of the ten packets to control its illumination. In this embodiment, because there are no more packets to send, the control module of the last light may not output any data. In an embodiment, the output connection of the last light may not be connected to any conductive data trace or may be omitted.

In an alternative embodiment, data may be transmitted over the data conductive trace 206 using a data structure having addressing for individual lights. In another alterative embodiment, data may be transmitted over the data conductive trace 206 using data structures individually addressed to each individual light or a subset of lights.

In an embodiment, the plurality of lights may be LED lights. The illumination of the plurality of lights may be individually controllable in terms of at least one of an on/off state, a color, and a power level, as described herein.

Figure 3A:
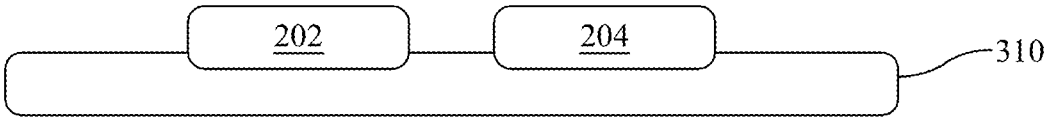
FIGS. 3A, 3B, and 3C are sectional schematic representations of different embodiments of an illuminated athletic wear garment according to the present invention.

As shown in FIG. 3A, the first conductive trace 202 and second conductive trace 204 may be applied directly to a fabric layer 310 (also referred to as a first piece of fabric) of the illuminated athletic wear garment 200. For example, the first conductive trace 202 and the second conductive trace 204 may be printed directly on the fabric layer 310 of the illuminated athletic wear garment 200.

In an embodiment, one or more water-resistant layers (e.g., one or more of an overlay and an underlay) may be applied to the first conductive trace 202 and the second conductive trace 204. For example, in operation 108, a water-resistant overlay 312 (FIG. 3B) may be applied to the first conductive trace 202 and the second conductive trace 204. The water-resistant overlay 312 may be applied such that edge margins 314 of the overlay 312 extend beyond the conductive traces and overlay a portion of the surface of the fabric layer 310 of the illuminated athletic wear garment 200 thereby providing complete surface coverage of the first conductive trace 202 and the second conductive trace 204. In an embodiment, a water-resistant underlay 316 may be applied under the first and second conductive traces 202, 204 (e.g., applied before the first and second conductive traces are applied in operations 102 and 104). In an embodiment having a data conductive trace 206, the water-resistant overlay (and if used, underlay) may be applied to the data conductive trace. In some embodiments, the underlay 316 and/or the overlay 312 may form a substrate for the conductive traces to be applied to. Such an embodiment is described more below.

The water-resistant layers may in some embodiments completely resist passage of water therethrough (a.k.a. "waterproof") while in others may have a capability of resisting water passage therethrough to an extent. The term "water-resistant" may include these various degrees of water resistance, including "water-proof".

Figure 3B:
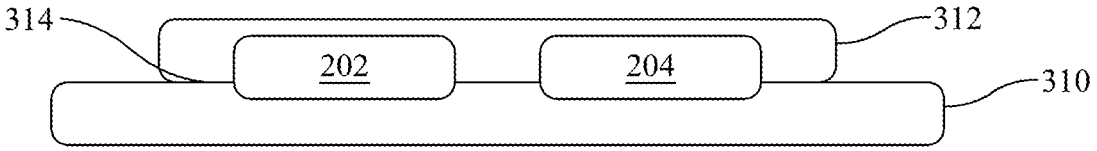
Figure 3C:
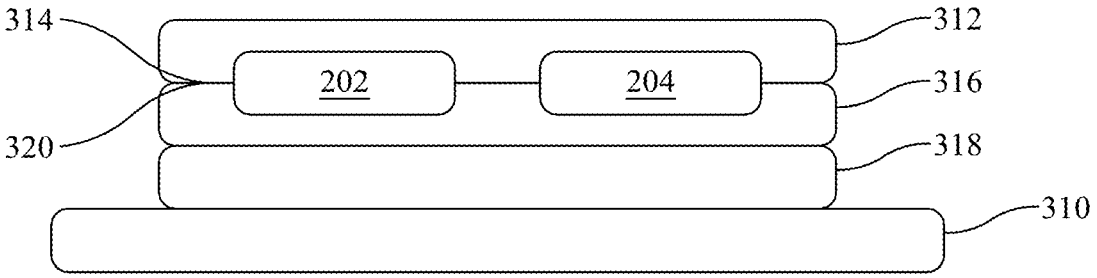

As shown in FIG. 3C, a water-resistant underlay 316 may be provided in an embodiment. For example, the first conductive trace 202 and the second conductive trace 204 may be provided in between the water-resistant overlay 312 and the water-resistant underlay 316. One or more of the water-resistant overlay 312 and the water-resistant underlay 316 may be such that edge margins thereof 314, 320 may extend beyond the conductive traces thereby encapsulating (except for connection ports) the ink traces thereby electrically insulating the first conductive trace 202 and the second conductive trace 204. In an embodiment, the edge margins 314, 320 may be heat-sealed. In an alternative embodiment, the edge margins 314, 320 may be glued to each other via an adhesive.

In an embodiment, an adhesive layer 318 may be provided on top of the fabric layer 310 of the illuminated athletic wear garment 200. The first conductive trace 202 and the second conductive trace 204 may be provided on top of the adhesive layer 318. Alternatively, the water-resistant underlay 316 may be provided on top of the adhesive layer 318, as shown in FIG. 3C.

In an embodiment, the first conductive trace 202 and the second conductive trace 204 may be printed directly on the water-resistant overlay 312, the underlay 316, or both, thereby forming a conductive trace sheet. In an embodiment, the overlay 312 and the underlay 316 may be joined together thereby forming the conductive trace sheet. The conductive trace sheet may be joined to the fabric layer 310 of the illuminated athletic wear garment 200 by the adhesive layer 318.

Figure 4:
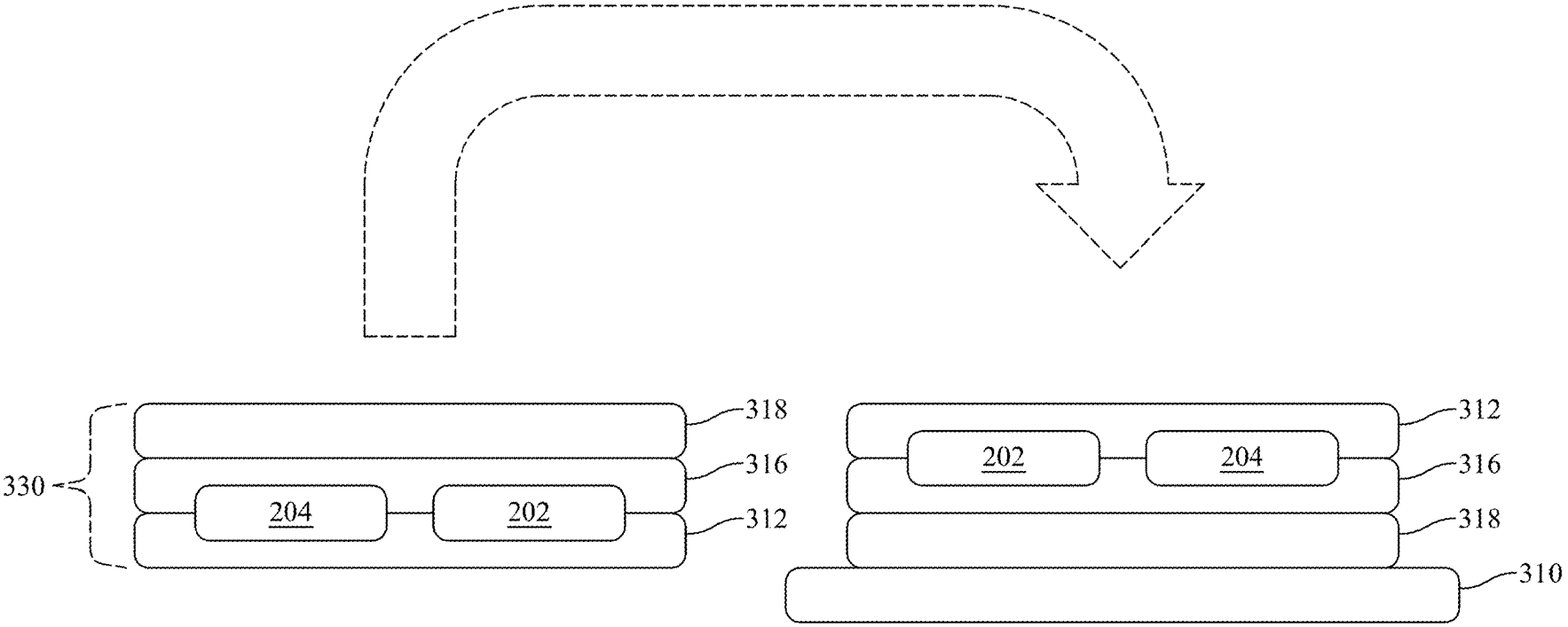
FIG. 4 is a sectional schematic representation of a conductive trace sheet being applied to the fabric layer of the illuminated athletic wear garment of FIG. 2.

For example, FIG. 4 is a sectional schematic representation of a conductive trace sheet 330 being applied to the fabric layer 310 of the illuminated athletic wear garment 200 of FIG. 2. One side of the conductive trace sheet 330 may contain an adhesive layer 318. In an embodiment, adhesive layer 318 may be heat activated. When the heat activated adhesive layer 318 of the conductive trace sheet 330 is pressed against the fabric layer 310 and heat is applied, the conductive trace sheet 330 may be firmly affixed to the fabric layer 310 of the illuminated athletic wear garment 200. In an embodiment, the adhesive layer may be formed from a water-resistant adhesive.

Figures 5A, 5B:
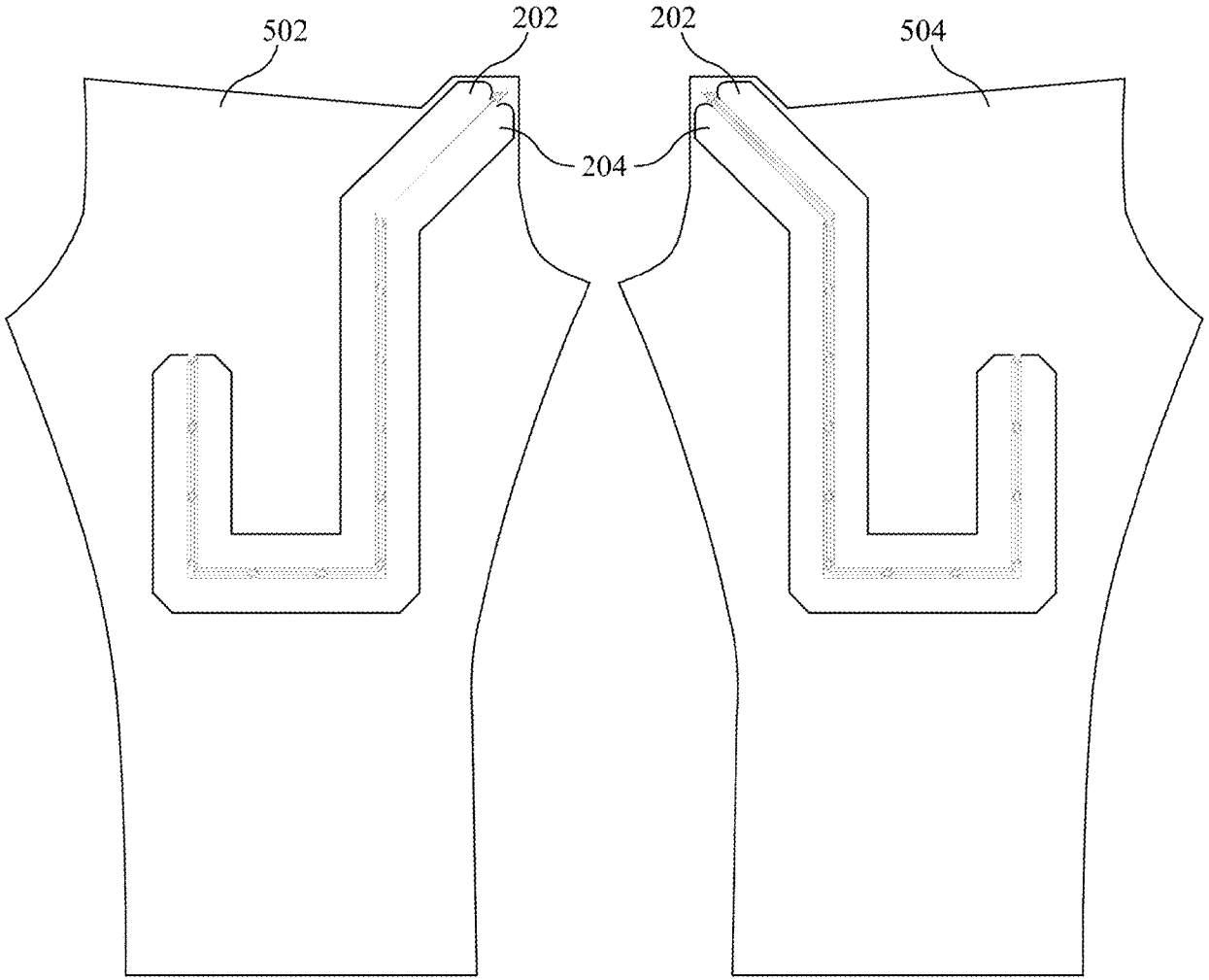
FIGS. 5A and 5B are schematic representations of pre-cut upper leg sections of an illuminated athletic wear garment, such as the illuminated athletic wear garment of FIGS. 2A, 2B, and 2C.

In an embodiment, the fabric layer 310 of the illuminated athletic wear garment 200 may be a pre-cut pattern when the first conductive trace 202 and the second conductive trace 204 are applied, whether directly or with other layers as shown in FIGS. 3A, 3B, and 3C, or as a part of the conductive trace sheet 330 as shown in FIG. 4. For example, as shown in FIGS. 5A and 5B, pre-cut upper leg sections 502, 504 may be provided. As shown, the pre-cut upper leg sections 502, 504 may correspond to right and left legs of an illuminated athletic wear garment, such as the illuminated athletic wear garment 200 of FIGS. 2A, 2B, 2C.

FIG. 6 is a schematic representation of an exemplary conductive trace sheet 600, such as the conductive trace sheet 330 of FIG. 4. The conductive trace sheet 600 may be a transparent water-resistant layer (overlay or underlay or both) that may include the first conductive trace 202, the second conductive trace 204, and the data conductive trace 206 (including segments 206*a*, 206*b*, . . . 206*n*). Although not shown, the conductive trace sheet 600 may include perforations or otherwise be cut beyond the outer edges of the first and second conductive traces 202, 204 generally in the same outer pattern so as to provide edge margins such as edge margins 314.

The pattern of the conductive trace sheet 600 includes generally four straight portions 652, 654, 656, 658 of each of the first, second, and data conductive traces 202, 204, 206. One of ordinary skill in the art will appreciate that alternative patterns are possible and are within the scope of the present invention. A specific pattern may be determined with consideration of one or more factors including manufacturability, ease of handling and use, and performance characteristics. For example, a performance characteristic that is desirable is that the illuminated athletic wear garment provide increased visibility of an athlete from all directions, which lends itself to at least three to four sides of the athlete being illuminated. For example, in the embodiment shown in FIG. 6, two of the four straight portions 654, 658 extend along leg portions of an athlete thereby providing 360 degree visibility. Another performance characteristic is the resistance of, e.g., the first and second conductive traces even when they are bent or stretched during use by the athlete. Accordingly, in an embodiment, wave shaped (e.g., sinusoidal snaking S type pattern) first and second conductive traces may be provided instead of straight portions so as to improve resistance even the first and second conductive traces are bent or stretched during use. For manufacturing or other reasons, the data conductive trace may also be similarly shaped. As yet another alternative, a cross-hatch pattern may be used for the first, second, and/or data conductive traces to improve flexibility and stretchability. Dimensions of cross-hatch pattern conductive traces may fall within the dimensions of solid conductive traces, as set forth above.

In an embodiment, the overlay or underlay (or both) may completely cover all conductive traces (first, second, and data). Holes (not shown because the water-resistant layer is transparent and not visible in FIG. 6) may be formed in an overlay at each of the connection points of each of the data conductive trace segments (and the first and second conductive traces) to allow for electric connection between lights (and/or light modules) and the first, second, and data conductive traces 202, 204, 206. More specifically, in the area of each juncture of the data conductive trace segments 206*a*, 206*b*, . . . 206*n*, a light module may be mounted and there may be a hole to align with each of the connection to the first conductive trace, the connection to the second conductive trace, the input connection to one of the plurality of data conductive trace segments, and the output connection to one of the plurality of data conductive trace segments.

Figure 7:
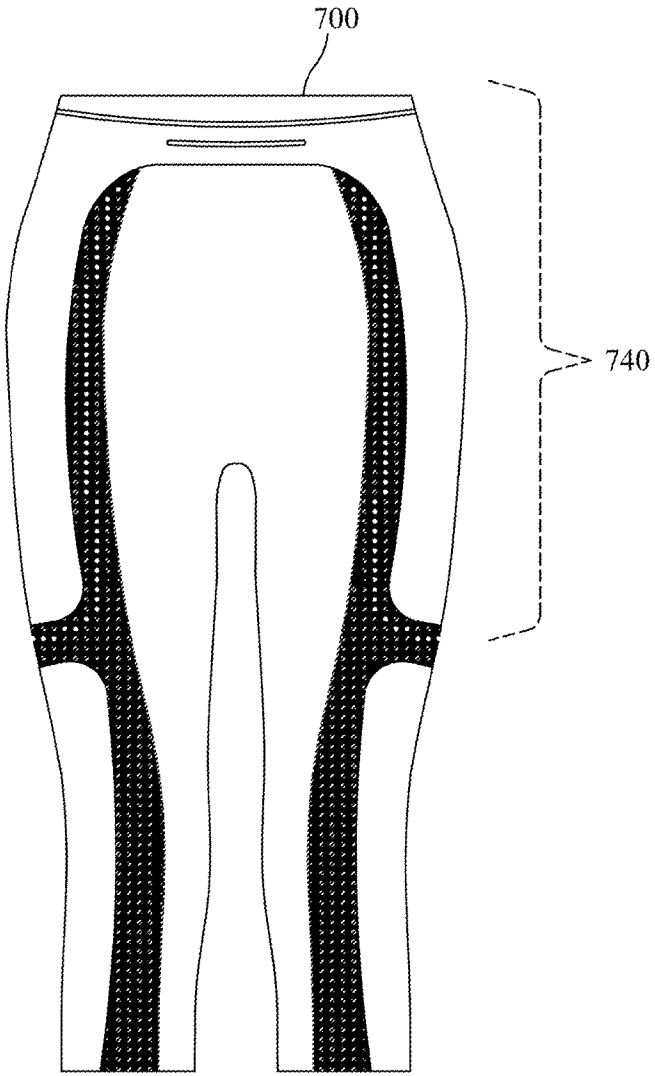
FIG. 7 is a schematic representation of an illuminated athletic wear garment according to an embodiment of the present invention.

FIG. 7 is a schematic representation of an illuminated athletic wear garment 700 according to an embodiment of the present invention. As shown, lights 740 of the illuminated athletic wear garment 700 are shown as illuminated.

Figure 8:
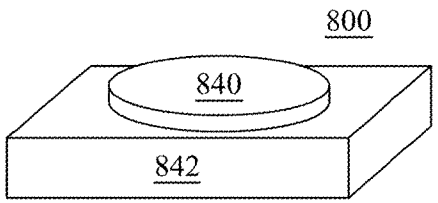
FIG. 8 is a schematic representation of a light module according to an embodiment of the present invention.

FIG. 8 is a schematic representation of a light module 800 according to an embodiment of the present invention. The light module 800 may include a light 840 (e.g., an LED light) and a control module 842. Accordingly, affixing lights to an athletic wear garment may include affixing one or more light modules 800 which each include a light 840. For example, an epoxy (e.g., a conductive epoxy having silver or another conductive material) may be used as an adhesive to affix one or more light modules 800. In another embodiment, a low temperature solder (e.g., having a melting point less than 150 degrees Celsius) may be used. Similarly, connecting the lights to the first conductive trace 202 and the second conductive trace 204 may include connecting one or more light modules 800 to the first and second conductive traces 202, 204 (and if appropriate, data conductive trace 206). The control module may contain one or more electrical connections, such as a connection to the first conductive trace, a connection to the second conductive trace, an input connection to one of the plurality of data conductive trace segments, and an output connection configured for connection to another of the plurality of data conductive trace segments. The conductive epoxy or low temperature solder may provide an electrical connection between each of the electrical connections of the control module 842 and the first, second, and data conductive traces. In an embodiment, anisotropic conductive film may be used in connecting electrical connections and conductive traces. In an embodiment, screen printing may be used to place epoxy or solder on the conductive ink or solder which is printed on a substrate such as the underlay forming part of the conductive ink sheet. In the low temperature solder embodiment, the relatively low melting point of the low temperature solder will not harm the substrate. The control module 842 may contain logic (e.g., as circuitry) enabling control of the light. For example, the control module 842 may receive an input data signal through the input connection. The input data signal may contain data for the current light module, and may contain data for downstream light modules such that each light module is individually controllable. The data for the current light module 800 may be processed by the control module 842 and control the light 840 in terms of various characteristics. For example, control may be made regarding on/or off, a color (e.g. pink, red, blue, green, etc.), and a power level (e.g., brightness, etc.). These characteristics, when predetermined for a number of the light modules, may result in, e.g., blinking patterns, color patterns, and the like.

According to the embodiments, methods of manufacturing illuminated athletic wear garments are provided, as are improved athletic wear garments. The embodiments provide for a number of improvements, including, e.g., high visibility for an athlete at night. Another improvement is that such high visibility is provided without noticeably adding weight or requiring the athlete to carry a device such as a flashlight. Another improvement includes the durability, simplicity, and washability provided by the conductive traces, thereby removing the need for wires, which some users may find objectionable.

It should be understood that this description is not intended to limit the invention. On the contrary, the embodiments are intended to cover alternatives, modifications and equivalents, which are included in the spirit and scope of the claims. Further, in the detailed description of the embodiments, numerous specific details are set forth in order to provide a comprehensive understanding of the invention. However, one skilled in the art would understand that various embodiments may be practiced without such specific details.

Although the elements of the present embodiments are described in the embodiments in particular combinations, each element can be used alone without the other elements of the embodiments or in various combinations with or without other elements disclosed herein.

This written description uses examples of the subject matter disclosed to enable any person skilled in the art to practice the same, including making and using any devices or systems and performing any incorporated methods. The patentable scope of the subject matter may include other examples that occur to those skilled in the art. Such other examples are intended to be within the scope of the present application.

The invention claimed is:

1. A method of manufacturing an illuminated athletic wear garment, comprising:

applying a first conductive trace to a first piece of fabric of the illuminated athletic wear garment;

applying a second conductive trace to the first piece of fabric of the illuminated athletic wear garment;

applying a water-resistant overlay to the first conductive trace and the second conductive trace;

affixing a plurality of lights to the illuminated athletic wear garment, wherein the plurality of lights are each connected to the first conductive trace and the second conductive trace, wherein the first conductive trace and the second conductive trace are affixed to the water-resistant overlay and wherein a water-resistant underlay is applied to the first conductive trace and the second conductive trace, thereby forming a conductive trace sheet, and wherein the conductive trace sheet is affixed to the first piece of fabric of the illuminated athletic wear garment.

2. The method of claim 1, wherein edge margins of the water-resistant overlay cover a portion of a surface of the first piece of fabric.

3. The method of claim 1, wherein the conductive trace sheet is affixed to the first piece of fabric before the plurality of lights are affixed to the illuminated athletic wear garment, and wherein the conductive trace sheet contains at least one hole corresponding to each of the plurality of lights.

4. The method of claim 3, wherein the plurality of lights are affixed to the first conductive trace and the second conductive trace by a conductive adhesive.

5. The method of claim 1, further comprising sewing the first piece of fabric with others so as to form the illuminated athletic wear garment.

6. The method of claim 5, wherein the first conductive trace and the second conductive trace each extend into a waistband of the illuminated athletic wear garment.

7. The method of claim 1, wherein the plurality of lights are connected physically to the first conductive trace and the second conductive trace in parallel.

8. The method of claim 1, wherein the first conductive trace and the second conductive trace are each stretchable.

9. The method of any of claim 1, wherein the plurality of lights comprise of at least three lights.

10. The method of any of claim 1, further comprising:

applying a data conductive trace to the surface of the fabric, wherein the plurality of lights each include a control module, wherein the data conductive trace is formed of a plurality of data conductive trace segments, wherein each control module comprises a connection to the first conductive trace, a connection to the second conductive trace, an input connection to one of the plurality of data conductive trace segments, and an output connection configured for connection to another of the plurality of data conductive trace segments, and wherein an illumination of each of the plurality of lights is individually controllable.

11. The method of claim 10, wherein a control module of a first of the plurality of lights receives an input data signal through the input connection and transmits an output signal through the output connection.

12. The method of claim 10, wherein the plurality of lights are LED lights.

13. The method of claim 10, wherein the illumination of the plurality of lights is individually controllable in terms of at least one of an on/off state, a color, and a power level.

14. The method of claim 1, wherein the first conductive trace and the second conductive trace comprise a metal.

15. An illuminated athletic wear garment, comprising:

a first conductive trace affixed to the illuminated athletic wear garment;

a second conductive ink trace affixed to the illuminated athletic wear garment;

a data conductive trace affixed to the illuminated athletic wear garment; and a plurality of lights each connected to the first conductive ink trace and the second conductive ink trace, wherein the plurality of lights are each connected to the first conductive trace and the second conductive trace, wherein the plurality of lights each include a control module, wherein the data conductive trace is formed of a plurality of data conductive trace segments, wherein each control module comprises a connection to the first conductive trace, a connection to the second conductive trace, an input connection to one of the plurality of data conductive trace segments, and an output connection configured for connection to another of the plurality of data conductive trace segments, and wherein an illumination of each of the plurality of lights is individually controllable.

16. The illuminated athletic wear garment of claim 15, further comprising a water-resistant overlay applied to the first conductive trace and the second conductive trace.

17. The illuminated athletic wear garment of claim 16, wherein edge margins of the water-resistant overlay cover a portion of the outer surface of the illuminated athletic wear garment.

18. The illuminated athletic wear garment of claim 15, wherein the first conductive trace and the second conductive trace comprise a metal.

19. A method of manufacturing an illuminated athletic wear garment, comprising:

applying a first conductive trace to a first piece of fabric of the illuminated athletic wear garment;

applying a second conductive trace to the first piece of fabric of the illuminated athletic wear garment;

applying a data conductive trace to the surface of the fabric, and affixing a plurality of lights to the illuminated athletic wear garment, wherein the plurality of lights are each connected to the first conductive trace and the second conductive trace, wherein the plurality of lights each include a control module, wherein the data conductive trace is formed of a plurality of data conductive trace segments, wherein each control module comprises a connection to the first conductive trace, a connection to the second conductive trace, an input connection to one of the plurality of data conductive trace segments, and an output connection configured for connection to another of the plurality of data conductive trace segments, and wherein an illumination of each of the plurality of lights is individually controllable.

* * * * *